US006173706B1

(12) United States Patent
McConnell

(10) Patent No.: US 6,173,706 B1
(45) Date of Patent: Jan. 16, 2001

(54) ARCHERY BOW BREECH DEVICE

(76) Inventor: William R. McConnell, 301 Upper Sand Valley Rd., Jonesborough, TN (US) 37659

( * ) Notice: Under 35 U.S.C. 154(b), the term of this patent shall be extended for 0 days.

(21) Appl. No.: 09/494,910

(22) Filed: Jan. 31, 2000

Related U.S. Application Data

(63) Continuation-in-part of application No. 09/071,230, filed on May 1, 1998, now abandoned.

(51) Int. Cl.[7] ..... F41B 5/18
(52) U.S. Cl. ..... 124/35.2
(58) Field of Search ..... 124/35.2

(56) References Cited

U.S. PATENT DOCUMENTS 3,604,407 * 9/1971 Wilson et al. ..... 124/35.2
4,539,968 * 9/1985 Garvison ..... 124/35.2
4,567,875 * 2/1986 Fletcher ..... 124/35.2
4,625,705 * 12/1986 Willits ..... 124/35.2
4,672,945 * 6/1987 Carlton ..... 124/35.2
4,969,448 * 11/1990 Beyer ..... 124/35.2
5,103,796 * 4/1992 Peck ..... 124/35.2
5,448,983 * 9/1995 Scott ..... 124/35.2

* cited by examiner

*Primary Examiner*—John A. Ricci

(57) ABSTRACT

A breech device for assisting in drawing and releasing an archery bow string, the device having an elongated body, a trigger pivotally mounted on the body and extending generally upwardly beyond the top of the body, a latch arrest roller on the trigger and having an arc segment, a latch arm pivotally mounted at one end on the body and having a latch point at its other end, the latch arm being pivotal for engaging its latch point with the arrest roller within the arc segment and preventing pivotal rearward movement of the latch arm in its firing direction until the trigger is manually, forcibly, rearwardly pivoted toward its firing position, a bowstring keeper on one end of the latch arm whereby tension applied to the keeper by drawing of the bowstring will tend to pivot the latch arm in a direction tending to forcibly maintain engagement of the latch point with the arrest roller, and wherein the keeper has a non-typical large bowstring contact area.

27 Claims, 3 Drawing Sheets

ARCHERY BOW BREECH DEVICE

BACKGROUND OF THE INVENTION

This application is a continuation-in-part of Ser. No. 09/071,230 of same title, filed May 1, 1998 now abandoned.

FIELD

This invention concerns a unique firing mechanism or breech device for archery bows, i.e., for target or hunting bows, wherein the bow string is retained by a releasable latch mechanism, which mechanism is preferably quickly removably mounted on the archer's fingers by a sling device.

PRIOR ART

Heretofore, many bowstring release devices have been proposed, a few of which are shown, for example, in U.S. Pat. Nos. 4,041,926; 5,448,983; 4,567,875; 4,309,975; 4,458,659; and 4,022,181. Such devices typically are encumbered in one or more of the aspects of complexity, cost of manufacture, dimensionally too large for rapid deployment in the field, difficult to use rapidly and to recock, bulkiness when stored in pockets or the like or when simply being stored or held in the archers hand, lack of smoothness and accuracy in use, excessive physical abuse of the bowstring upon repeated firings, cocking of the device requiring excessive motion by the archer which is visible to the game, a partial pull of the trigger cannot easily be retracted where the archer changes his mind to not shoot at that particular instant, or requires too much time, e.g., to retrieve from a pocket and properly affix to a bowstring.

OBJECTS OF THE INVENTION

Objects therefore, of the present invention are: to provide a breech device which is simple and sturdy in construction; which essentially has only three mechanical moving parts; which is compact and easily pocketed and retrieved; which is readily adjustable to vary the trigger sensitivity; which is quickly attachable to a bowstring with little motion by the archer; which is easy on bowstring wear; which in one embodiment injects an element of surprise into the firing operation; and which, by virtue of its construction and finger mounting, is extremely smooth and accurate in use.

SUMMARY OF THE INVENTION

The above and other objects hereinafter appearing have been attained in accordance with the present invention which in one of its broad embodiments and as viewed and interpreted from the drawings herein, and particularly FIGS. 1, 15 and 18, is defined as a breech device for assisting in drawing and releasing an archery bow string, said device comprising a body member having a forward end, a rearward end, an upper portion, a lower portion, a vertically oriented longitudinally extending structural plane, and a longitudinal axis, said forward end comprising support wall means on each side of said plane and forming a generally vertically oriented gap means opening generally longitudinally outwardly at said forward end, trigger means positioned in said gap means and extending generally vertically from said lower portion thru said upper portion and extending upwardly therebeyond, first pivot means on said trigger means and said lower portion for allowing pivoting of said trigger member back and forth generally in said plane, first shoulder means on said trigger means positioned above said first pivot means and within said gap means, latch arm means positioned in said gap means and having a forward end and a rearward end and having a second shoulder means at its rearward end, second pivot means on said forward end of said latch arm means and said forward end of said body member for allowing downward pivoting of said latch arm means within said gap means for engaging said second shoulder means with said first shoulder means and preventing pivoting rearward movement of said trigger means in its firing direction until said trigger means is manually rearwardly pivoted toward its firing position, said second shoulder means and said second pivot means lying in a pivot radius, a bowstring keeper extending downwardly on said forward end of said latch arm means and lying on said first shoulder means side of said pivot radius whereby tension applied to said keeper by drawing of said bowstring will tend to pivot said latch arm means in a direction tending to forcibly maintain engagement of said first and second shoulder means in the cocked trigger position.

In certain preferred embodiments:

(a) said keeper is provided with a laterally extending convex bowstring contact surface which faces generally rearwardly of said body member when said latch arm means is in its position against said arrest shoulder means;

(b) said contact surface has a lateral length of between about 0.5 and 0.75 inches;

(c) an adjustable finger sling is provided on the rearward portion of said body member wherein the sling has a unique and extremely stable capacity adjusting mechanism;

(d) a means is provided for adjusting the trigger sensitivity, i.e., from amateur level to professional hair-trigger action;

(e) a means is provided for adjusting the pull force required for the trigger, i.e., soft pull to hard pull; and (f) one of the first and second shoulder means comprises a roller member rollably mounted by shaft means on the trigger means or the latch arm means, respectively.

BRIEF DESCRIPTION OF THE DRAWINGS

The invention will be further understood from the drawings herein and description thereof, wherein the figures are not necessarily drawn to scale and wherein certain structural portions are enlarged for clarity.

DETAILED DESCRIPTION OF THE DRAWINGS

Figure 1:
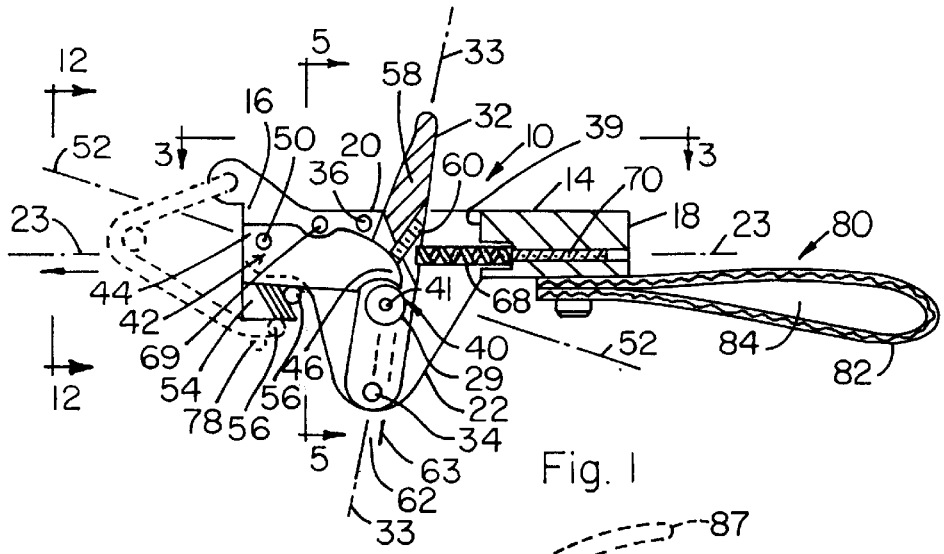
FIG. 1 is an enlarged longitudinal cross-sectional view taken along line 1—1 of FIG. 3 in the direction of the arrows, of the present archery bow breech device in its cocked mode and given a small bite depth adjustment toward greater trigger sensitivity, and provided with a supplemental bowstring pull shown in dotted outline.
Figure 3:
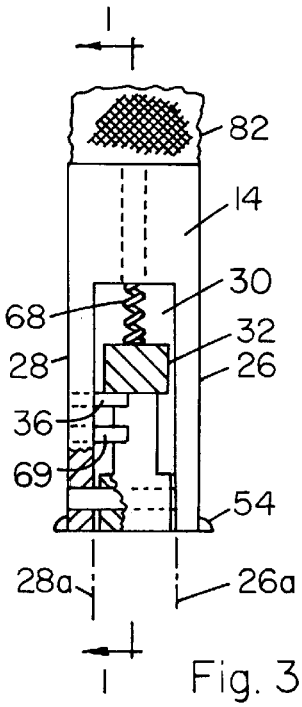
FIG. 3 is a top view of the device of FIG. 1 taken in the general direction of line 3 in FIG. 1, in its cocked mode and with portions thereof broken away for clarity.

Referring to the drawings and with particular reference to the claims hereof, the present breech device 10, in one preferred embodiment, comprises a body member 14, preferably of metal or tough structural plastic and having, in a general geometric sense, a forward end portion 16, a rearward end portion 18, an upper portion 20, a lower portion 22, and a longitudinal axis 23. The actual shapes of these portions can vary widely. For purposes of clarity as well as for preferred construction, the laterally oriented structural components of the body member are substantially structurally and operationally symmetrical to each side of a vertically oriented longitudinally extending structural plane 24. Forward end 16 is preferably provided as a pair of support walls 26, 28 on each side of plane 24 and form a generally vertically oriented gap 30 which opens generally longitudinally outwardly at the forward end 16. A trigger member 32 of any desired configuration is positioned in the gap and extends generally vertically along a trigger axis 33 from lower portion 22 thru upper portion 20 and extending upwardly therebeyond whereby it is readily accessible to finger actuation. Axis 33 in the embodiment of FIG. 15 varies slightly in posture since it represents the unregulated position of the trigger in its cocked condition as will be explained below. This trigger member is preferably bifurcated at its lower section to provide spaced legs 37, 38.

Figure 8:
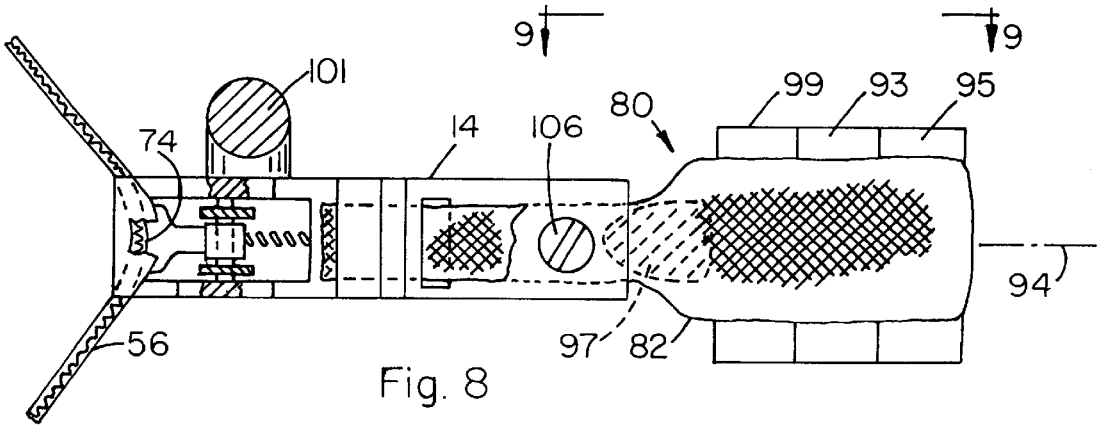
FIG. 8 is a bottom view of the device as taken in the general direction of line 8 in FIG. 2 with certain structures removed or broken away and with the base means of the device shown markedly elongated for clarity, and with the bowstring in its drawn posture and showing a preferred embodiment of the present finger sling.

The terms laterally, vertically, clockwise, counterclockwise, or other geometric nonenclarture are used herein in a relative sense for description purposes, e.g., the plane of one part being normal to the plane of another part might be defined as one part vertical and the other horizontal, and not to indicate that, for example, structural plane 24 is always vertical with respect to the earth surface. In this regard, as shown in FIG. 8, the conventional firing position of plane 24 is substantially horizontal but is generally oriented normally to the axis of axle member 41 and for convenience is designated vertical.

A first pivot means 34 such as a shaft 35 pivotally mounts the trigger member on lower portion 22 for allowing pivoting of the trigger member back and forth generally in plane 24. First and second stop means such as 36, 39 of any configuration are provided on any suitable or convenient portion of the device for limiting the extent of pivoting of the trigger member in either the forward or rearward direction respectively, when the device is in its uncocked or fired condition. This pivot limiting action facilitates re-cocking of the device. A latch arrest shoulder means generally designated 40, which may be in the form of a curved stationary surface but which, preferably, is provided as a hardened steel roller 29, is preferably mounted on the trigger member by axle member 41 or equivalent structure at a position above the first pivot means 34. This shoulder means or roller has at least a first quadrant arc segment such as 43 of the approximate angular dimension shown and arced generally upwardly as viewed in the drawing. The segment may, of course, be larger than shown should a longer trigger pull be desired. A latch arm means 42 is positioned in the gap and has a forward end 44 and a rearward end 46 with a latch point 48 formed at said rearward end. A second pivot means 50 such as shaft 51 mounted thru the forward end of the latch arm means and mounted on the forward end 16 of the body member allows downward pivoting of the latch arm means within the gap for engaging the latch point 48 with the arrest shoulder means within said first quadrant arc segment such as 43, thereby preventing rearward pivoting movement of the latch arm means in its firing direction until the trigger member is manually, forcibly, rearward pivoted toward its firing position. Latch point 48 and second pivot means 50 lie on a pivot radius line 52. This line and said trigger axis form a downwardly opening angle "$\alpha$" of from about 75° to about 110° when said trigger means is in its cocked position. A bowstring keeper 54 extends downwardly on the forward end of the latch arm means and lies on the latch arrest shoulder means side of pivot radius 52 whereby tension applied to the keeper 54 by drawing of the bowstring 56 will tend to pivot the latch arm means in a direction tending to forcibly maintain engagement of the latch point with the arrest shoulder means.

Figure 6:
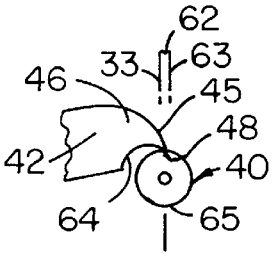
FIG. 6 is a side view of the latch point portion of the latch arm of FIG. 1 showing the latch point in an adjusted position against the arrest shoulder means for providing hair-trigger firing action.
Figure 5:
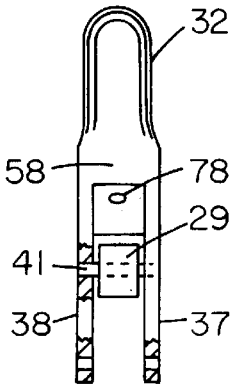
FIG. 5 is a front view of the trigger means of FIG. 1 taken in the direction of line 5 in FIG. 1 with only the latch arrest shoulder means shown mounted in place thereon.
Figure 7:
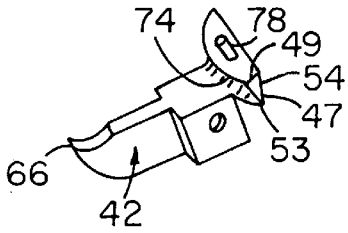
FIG. 7 is an isometric view of the latch arm of FIG. 1 looking generally in the direction of line 4 in FIG. 2.

A third stop means, preferably in the form of a screw 60 threaded thru the solid upper section 58 of trigger 32, is adapted to engage a rearward end portion 45 of the latch arm means to establish the position of contact of the latch point 48 on the arc segment 43 and thus determine the bite depth 62 as shown in FIG. 6. As the screw is threaded further thru the trigger, the latch point and its force axis 63 will be moved closer to the trigger axis 33 and the trigger sensitivity will increase. Where the bite depth 62 is very small, e.g., 1/16 inch or so, a hair-trigger sensitivity will exist. Likewise, when the screw is retracted away from portion 45, the bite depth 62 will be increased as the latch point and its force axis 63 move to the right in FIG. 6. The concavity of arcute recess 64 ensures that the latch point 48 shown in the form of lateral edge 66, as shown in FIG. 7, is preferably sharply defined such that very fine trigger sensitivity adjustments can be made.

Figure 14:
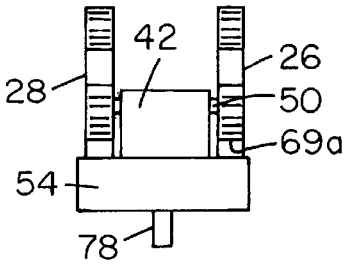
FIG. 14 is a front view of the device of FIG. 1 taken in the general direction of line 12 therein and showing the first stop means for engaging a portion of the keeper for preventing excessive upward pivoting of the latch arm means during trigger cocking.

It is noted that such a third stop means is not critical to the operation of the present device, since, for example, the curvature of recess 64 and of roller 37 may be cooperatively configured such that upon cocking of the latch arm by pivoting it counterclockwise upwardly (as viewed in FIG. 1) against the roller bottom 65 to forcibly pivot the trigger clockwise against the force of compression spring 68 to a position above the roller, the force of spring 68 will then seat the roller in recess 64 at a prescribed position and provide a secure predetermined position of the latch point with respect to arc segment 43. In order to limit and control the upward counterclockwise motion of latch arm 42 during the cocking operation, a fourth stop means such as pin 69 affixed to wall 26 or 28 may be provided. As shown in FIGS. 2 and 14, a lower edge portion 69*a* of either or both support wall means 26, 28 may be used to engage the keeper 54 during the cocking operation to function in a equivalent manner to 69 as the fourth stop means.

An adjusting screw 70 adjustably threaded endwise thru the body 14 and bearing against the end of spring 68 can further adjust the trigger pull sensitivity in addition to the frictional resistance between arrest shoulder means 40 and latch point 48 as developed by the reaction to the drawing force applied to the bow string.

Figure 15:
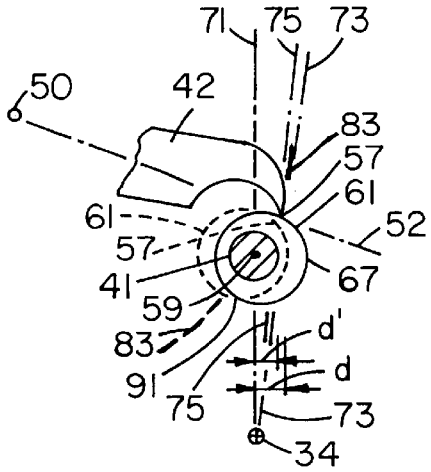
FIG. 15 is a side view of a cam-type roller engaged by the latch point wherein the trigger pull length is variable and cannot be anticipated by the archer.

Referring to FIG. 15, the roller means is provided as an eccentric roller 61 having a lobe portion 67. The periphery 91 of this roller is shown as circular but can be irregular. The purpose of the eccentric mounting is to provide an element of surprise to the archer as to exactly how much trigger pull is going to be required to bring the firing axis 71 of the trigger in alignment with the point of contact 57 of the latch point 48 with roller 61. When this alignment is reached, a hairs width more pull will overcenter latch point 48 on roller 61 and result in rearward thrust applied to the trigger and release of keeper 54 and bowstring 56.

The surprise firing results from the changing of the angular position of the roller 61 on axle 41 as a result of jiggling, jostling, or other motion of the device thru, for example, handling, transporting, or firing of the device. In this regard, roller 61 is able to rotate freely on axle 41 thru the aforesaid movement and its angular position will be unknown to the archer when the bowstring is placed over the keeper and the latch arm rotated to its cocked position.

This action is shown in FIG. 15 wherein in the cocked trigger position, the firing axis 71 passes thru trigger pivot 34 and the axis 59 of roller axle 41. When the trigger is pulled clockwise the roller is rotated counterclockwise to where the point 57 on the roller surface which the latch point 48 is engaging becomes aligned with firing axis 71. Further pulling force on the trigger will overcenter point 57 from axis 71 and release latch arm 42 downwardly and release the bowstring from the keeper. The precise firing position of the trigger can never be known or anticipated in advance by the archer since the angular position of the roller will always change from firing-to-firing.

The eccentric mounting offset for roller 61 may be, for example, from about 0.001 to about 0.100 inches, but preferably from about 0.003 to about 0.040 inches.

Referring further to FIG. 15 in which dimensions are selected only for descriptive purposes, the longer trigger pull axis 73 is created by the solid line angular position of roller 61 wherein d denotes the longer trigger pull required. The shorter trigger pull axis 75 is created by the dotted line angular position of roller 61 wherein d' denotes the shorter trigger pull required. As the roller is rotated from the solid to the dotted line position, the latch point 48 will move downwardly in an arc 83 until it engages roller periphery 91 and establishes the axis 75. Other angular positions of roller 61 will, of course, create other surprise trigger pulls.

Figure 4:
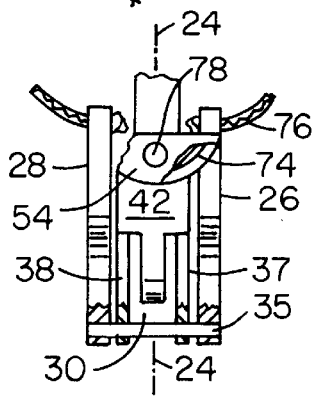
FIG. 4 is a front end view of the device taken generally in the direction of line 4 in FIG. 2 and showing a variation in the mounting of the pull loop.

Referring to FIGS. 4 and 7, the keeper portion 54 is formed on or joined to the latch arm at a junction which is formed with a radius to provide a long convex contact surface 74 which provides a smooth, non-abrasive pulling surface for the bowstring. In this regard surface 74 preferably is untypically long, i.e., of from about 0.5 to about 0.75 inches.

It will be apparent to those skilled in the art that the relative positions of the components of the present device may be reversed without altering the fundamental concepts of the invention. For example, the latch arm 42 may be inverted top-to-bottom whereby the recess 64 contacts the bottom of the roller in an arc segment equivalent to 41. In such a construction, the bowstring would contact the keeper at the top of the device rather than at the bottom, as viewed in FIG. 1. Further, in this regard, the terms upper and lower as used herein are for purposes of clarity and are not intended to limit any spatial orientation of the device which a user may desire.

It is noted that the present device also affords a uniquely mounted bowstring pull loop 76 for looping around a bowstring 56 and retaining peg 78 as an alternative to keeper 54. Such loops, in a general sense, are shown in U.S. Pat. No. 4,022,181 as elements 27 and 33, and in U.S. Pat. No. 4,567,875 as elements 82 and 46*b*. Such a structure can be used for certain purposes, such as archery practice, where rapid fire cocking and re-cocking may not be involved, or where less accuracy or bowstring wear can be tolerated.

Figure 16:
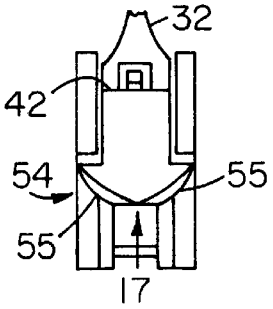
FIG. 16 is a view as in FIG. 4 but showing a preferred configuration for the keeper wherein the trigger is in the cocked position.
Figure 17:
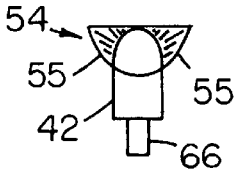
FIG. 17 is a view of the keeper taken in the direction of line 17 in FIG. 16 in the direction of the arrow.

Referring to FIGS. 16 and 17, a preferred configuration for the keeper 54 is shown as having rounded side portions 55 which allow the bowstring to be slipped on over the keeper much easier and also to allow the bowstring to release easier. This configuration functions so well as to eliminate the need for peg 78. The rounded side portions 55 eliminate the edges 47, 49 and 53 of FIG. 7.

Figure 18:
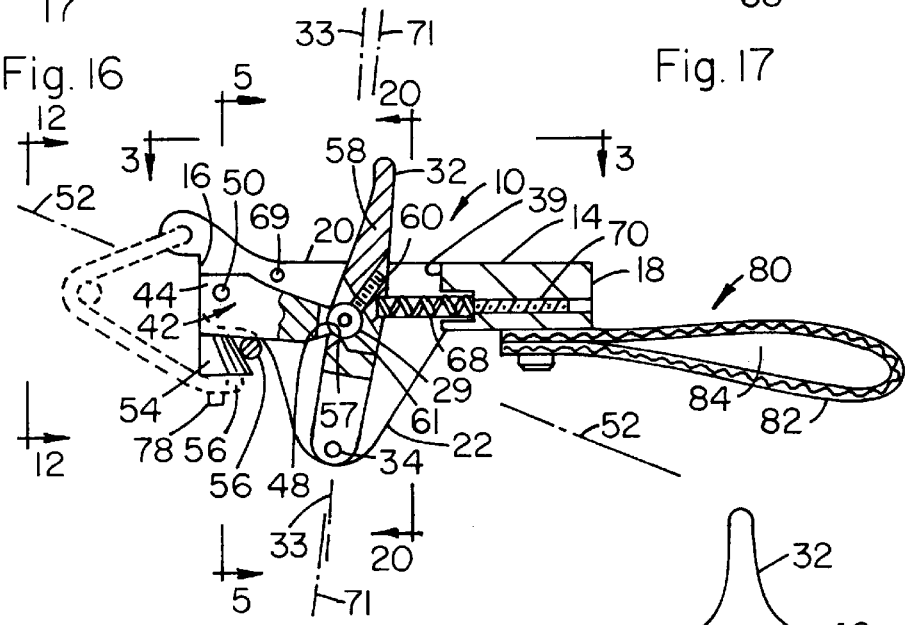
FIG. 18 is a view as in FIG. 1 but showing reverse positioning of the latch point and roller, and wherein structures equivalent in function to that of FIG. 1 are numbered the same.
Figure 19:
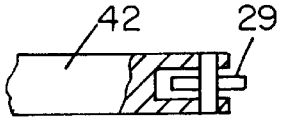
FIG. 19 is a top view of a portion of the latch arm of FIG. 18 with portions broken away for clarity.
Figure 20:
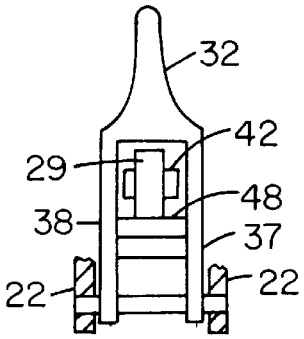
FIG. 20 is a view taken in the direction of line 20—20 in FIG. 18.

Referring to FIGS. 18–20 wherein structures which are equivalent in function to those previously described are numbered the same, the roller 29 or 61 is mounted on the latch arm 42 and the equivalent of latch point 48 is mounted on the trigger 32. As is seen in FIG. 18, as the trigger and its axis 33 are pivoted clockwise to pass just beyond the axis 71, the breech will fire.

Figure 2:
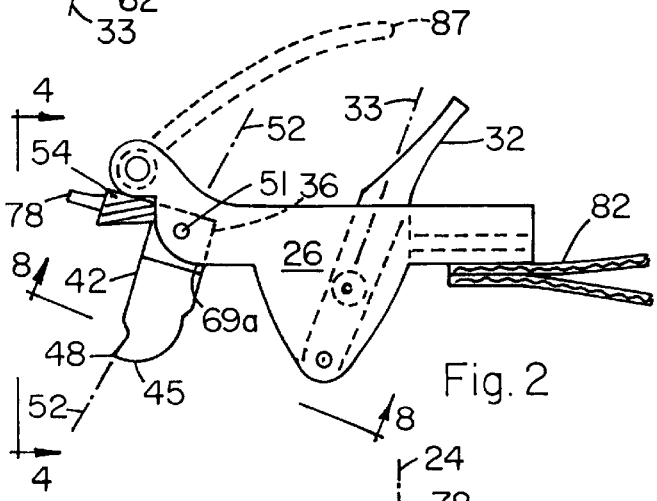
FIG. 2 is a side view of the device of FIG. 1 in its just-fired mode.
Figure 13:
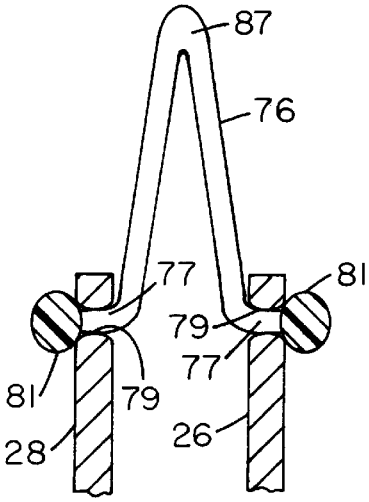
FIG. 13 is a cross-sectional view of the front portion of the support walls of the device of FIG. 1 showing a preferred mounting for the pull loop.

The present pull loop 76, preferably of a flexible but semi-rigid, i.e., not of floppy consistency, is mounted as shown in FIGS. 1 and 13 wherein the loop is mounted to lie between the planes 26*a* and 28*a* of the wall means 26 and 28 respectively. The mounting ends 77 of the loop are loosely fitted thru apertures 79 in said walls such as to allow said ends to readily rotate in said apertures and allow the apex 87 of the pull loop to fling outwardly and upwardly out of the way of the bowstring during firing as shown in FIG. 2. The ends 77 are formed with shoulders such as 81 to prevent demounting of the ends. These shoulders are readily formed by fusion of the ends with a resistance heater or the like where, for example, the loop material is a thermoplastic such as polyolefin or polyamide.

Figure 12:
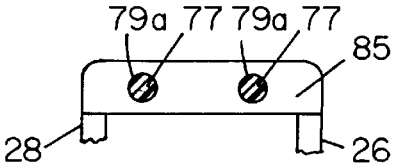
FIG. 12 is an enlarged front view of the device taken in the direction of line 12 in FIG. 1 and showing a variation of the mounting for the pull loop.

A variation but less preferred pull loop mounting structure is shown in FIG. 12 wherein the mounting ends 77 are inserted thru apertures such as 79*a* in a cross bar 85 spanning and affixed to the upper front end portions of walls 26 and 28.

Figure 9:
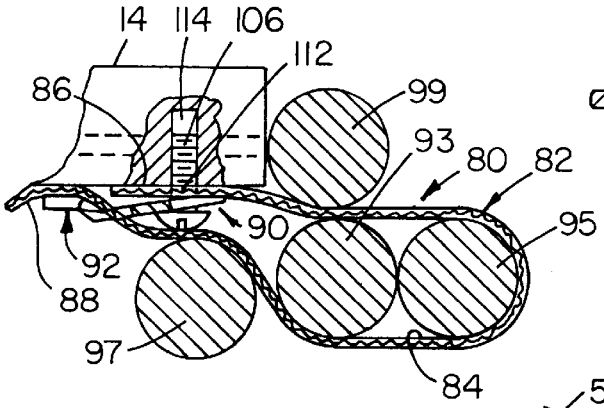
FIG. 9 is a side view of the present finger sling and a unique adjustable attachment means or mechanism therefor, for connecting an adjustable end of the sling to the rear portion of the base means taken in the general direction of line 9 in FIG. 8 and rotated downwardly 90° in the plane of the paper, and with portions broken away for clarity.
Figure 10:
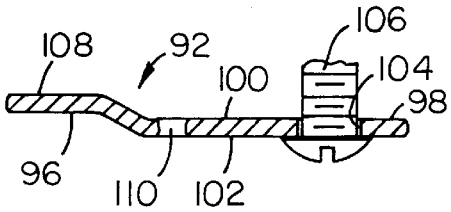
FIG. 10 is an enlarged cross-sectional view of a bar member of said attachment means of FIG. 9.
Figure 11:
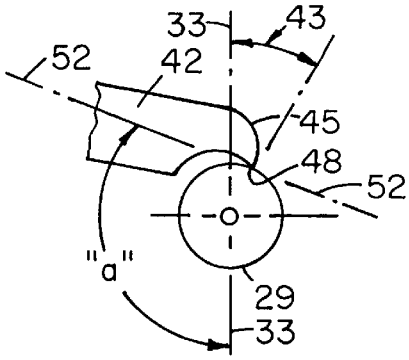
FIG. 11 is an enlarged schematic view of the geometric relationship of the latch arm means to the trigger member and latch arrest shoulder means.

Referring to FIGS. 8–10, the present adjustable finger sling generally designated 80 comprises a strap 82 of leather, natural or synthetic fabric, or other tough, strong and flexible material and adapted to be flexibly formed into a loop 84 having a fixed end 86 and an adjustable end 88. The sling size or capacity adjusting mechanism generally designated 90 comprises a substantially rigid, substantially flat bar member 92 having a generally rectangular configuration and being elongated along a general longitudinal axis 94 and having a front end section 96, a back end section 98, a proximal side 100 and a distal side 102. A first aperture 104 is formed thru said bar member adjacent said back end for receiving a fastener screw or bolt 106. The front end has a clamping portion 108 offset in a distal-to-proximal direction. A generally lateral slot 110 is formed thru the bar member at a position lying longitudinally intermediate aperture 104 and the clamping portion 108, and a second aperture 112 is formed thru the fixed end of the strap for receiving the fastener screw 106. A threaded bore 114 in the body member 14 receives screw 106 for tightening the screw head against the bar member and the fixed end of the strap.

In operation, when the fastener screw 106 is positioned thru the first and second apertures and threaded into the body member, and when the adjustable end of the strap is passed thru slot 110 from the distal side to the proximal side and then passed between the clamping portion 108 of the bar member and the rearward end of the body member, and when the fastener screw is tightened down against the bar member, the clamping portion 108 of the bar member will clamp the adjustable end of the strap against the body member and thus provide the desired and stable capacity of loop 84 for receiving the desired number and size of the archers fingers.

A preferred technique for right handed bowstring draw when using the present sling is to place the ring finger 93 and little finger 95 thru the loop as shown in FIG. 9, and then pinch the thumb 97 and index finger 99 toward each other with the forefinger 101 extended forwardly and curled inwardly to engage the trigger. It is noted that with the bow held by the left hand in a vertical position with the bowstring 56 also vertical as shown in FIG. 8, the posture of the fingers and the present breech device are substantially as shown in FIG. 8.

The invention has been described in detail with particular reference to preferred embodiments thereof, but it will be understood that variations and modifications will be effected with the spirit and scope of the invention.

I claim:

1. A breech device for assisting in drawing and releasing an archery bow string, said device comprising a body member having a forward end, a rearward end, an upper portion, a lower portion, and a vertically oriented longitudinally extending structural plane, said forward end comprising support wall means on each side of said plane and forming a generally vertically oriented gap means opening generally longitudinally outwardly at said forward end, trigger means positioned in said gap means and extending generally vertically along a trigger axis from said lower portion thru said upper portion and extending upwardly therebeyond, first pivot means on said trigger means and said lower portion for allowing pivoting of said trigger means back and forth generally in said plane, first and second stop means on said device for limiting the extent of pivoting of said trigger means in either the forward or rearward direction respectively, latch arrest shoulder means on said trigger means positioned above said first pivot means and within said gap means, said shoulder means having at least a first quadrant arc segment arced upwardly, latch arm means positioned in said gap means and having a forward end section and a rearward end section and having a latch point at said rearward end section, second pivot means on said forward end of said latch arm means and said forward end of said body member for allowing downward pivoting of said latch arm means within said gap means for engaging said latch point with said arrest shoulder means within said arc segment to thereby cock said trigger means and prevent pivoting rearward movement of said trigger means in its firing direction until said trigger means is manually, forcibly, rearwardly pivoted from its cocked position toward its firing position, said latch point and said second pivot means lying in a pivot radius line, a bowstring keeper means extending downwardly on said forward end section of said latch arm means and adapted to lie on said arrest shoulder means side of said pivot radius line in the cocked trigger position whereby tension applied to said keeper means by drawing of said bowstring will tend to pivot said latch arm means in a direction tending to forcibly maintain engagement of said latch point with said arrest shoulder means and thereby maintain said cocked trigger position until the trigger is pulled to fire.

2. The device of claim 1 wherein said pivot radius line and said trigger axis form a downwardly opening angle of from about 75° to about 110° when said trigger means is in its cocked position, wherein said keeper is provided with a laterally extending convex bowstring contact surface which faces generally rearwardly of said body member when said latch arm means is in its position against said arrest shoulder means, and wherein third stop means is provided on said trigger means for engaging a portion of said latch arm means for maintaining a preselected position of engagement of said latch point with said shoulder means within said arc segment.

3. The device of claim 2 wherein said contact surface has a lateral length of between about 0.5 and 0.75 inches.

4. The device of claim 2 wherein said third stop means comprises an adjustable screw mounted in said trigger means for adjusting the trigger means sensitivity from amateur level to professional hair-trigger action.

5. The device of claim 2 wherein said latch point comprises a sharp lateral edge on said rearward end section of said latch arm means, said edge being the terminus of an arcuate recess in a lower surface portion of said latch arm means.

6. The device of claim 5 wherein the radius of said recess is substantially the same as the radius of said arced segment.

7. The device of claim 5 wherein said shoulder means comprises a roller member rollably mounted by shaft means on said trigger member.

8. The device of claim 1 wherein an adjustable finger sling is mounted on the rearward portion of said body member by means of a sling capacity adjusting mechanism.

9. The device of claim 8 wherein said sling comprises a strap adapted to be flexibly formed into a loop having a fixed end and an adjustable end, and wherein said capacity adjusting mechanism comprises a substantially rigid, substantially flat bar member having a generally rectangular configuration and being elongated along a longitudinal axis and having a front end, a back end, a proximal side and a distal side, first aperture means formed thru said bar member adjacent said back end for receiving a fastener screw, said front end having a clamping portion offset in a distal-to-proximal direction, a slot formed generally laterally thru said bar member at a position lying longitudinally intermediate said aperture means and said clamping portion, and second aperture means formed thru said fixed end of said strap for receiving said fastener screw, whereby when said fastener screw is positioned thru said first and second aperture means and threaded into said rearward end of said body member, and when said adjustable end of said strap is passed thru said slot from said distal side to said proximal side and then passed between said clamping portion of said bar member and said rearward end of said body member, and when said fastener screw is tightened down against said bar member, said clamping portion of said bar member will clamp said adjustable end of said strap against said body member and thus provide the desired capacity of said loop.

10. The device of claim 1 provided with means for adjusting the firing pull force required for the trigger means, i.e., soft pull to hard pull.

11. The device of claim 1 wherein the latch arrest shoulder means comprises a roller member rollably mounted by shaft means on said trigger member.

12. The device of claim 11 wherein said latch point comprises a sharp lateral edge on said rearward end of said latch arm means, said edge being the terminus of an arcuate recess in a lower surface portion of said latch arm means.

13. The device of claim 12 wherein the radius of said recess is substantially the same as the radius of said roller member.

14. The device of claim 1 wherein said keeper means comprises the combination of an arcuate contact surface and a retaining peg means and a bowstring pull loop having each of its end portions loosely and pivotally mounted thru an aperture laterally formed thru each of said wall means to provide a closed loop having an apex portion, said pull loop being of semi-rigid but flexible material and adapted to be looped around a bowstring with its apex portion hooked over said peg means, whereby when said trigger means is actuated to fire the bow the pull loop becomes disengaged from said peg means and is flung in a pivotal manner outwardly and upwardly from said body means to clear the bowstring with a minimum of frictional engagement therewith.

15. The device of claim 14 wherein said pivot radius line and said trigger axis form a downwardly opening angle of from about 75° to about 110° when said trigger means is in its cocked position, wherein said keeper is provided with a laterally extending convex bowstring contact surface which faces generally rearwardly of said body member when said latch arm means is in its position against said arrest shoulder means, and wherein third stop means is provided on said trigger means for engaging a portion of said latch arm means for maintaining a preselected position of engagement of said latch point with said shoulder means within said arc segment.

16. The device of claim 15 wherein said third stop means comprises an adjustable screw mounted in said trigger means for adjusting the trigger means sensitivity from amateur level to professional hair-trigger action.

17. The device of claim 14 wherein said contact surface has a lateral length of between about 0.5 and 0.75 inches.

18. The device of claim 14 wherein an adjustable finger sling is mounted on the rearward portion of said body member by means of a sling capacity adjusting mechanism.

19. The device of claim 14 provided with means for adjusting the firing pull force required for the trigger means, i.e., soft pull to hard pull.

20. The device of claim 14 wherein said arrest shoulder comprises a roller member rollably mounted by shaft means on said trigger means.

21. The device of claim 20 wherein said latch point comprises a sharp lateral edge on said rearward end section of said latch arm means, said edge being the terminus of an arcuate recess in a lower surface portion of said latch arm means.

22. The device of claim 21 wherein the radius of said recess is substantially the same as the radius of said arced segment.

23. A breech device for assisting in drawing and releasing an archery bow string, said device comprising an elongated body member having a forward end portion, a center portion and a rearward end portion, said member being generally oriented along a longitudinally extending structural plane, trigger means having a trigger axis and being pivotally mounted on said center portion by first pivot means for allowing pivoting of said trigger means back and forth generally along said structural plane, first and second stop means on said device for limiting the extent of pivoting of said trigger means in either the forward or rearward direction respectively, latch arrest shoulder means on said trigger means and spaced from said first pivot means, said shoulder means having at least a first quadrant arc segment, latch arm means having a forward end section and a rearward end section and having a latch point at its rearward end section, second pivot means on said forward end section of said latch arm means and said forward end portion of said body member for allowing pivoting of said latch arm means for engaging said latch point with said arrest shoulder means within said arc segment and preventing pivoting rearward movement of said trigger means in its firing direction until said trigger means is manually, forcibly, rearwardly pivoted toward its firing position, said latch point and said second pivot means lying in a pivot radius, a bowstring keeper on said forward end of said latch arm means and lying on the arrest shoulder means side of said pivot radius whereby tension applied to said keeper by drawing of said bowstring will tend to pivot said latch arm means in a direction tending to forcibly maintain engagement of said latch point with said arrest shoulder means wherein an adjustable finger sling is provided on the rearward portion of said body member wherein the sling has a unique and extremely stable finger size capacity adjusting mechanism.

24. The device of claim 23 wherein said keeper is provided with a laterally extending convex bowstring contact surface which faces generally rearwardly of said body member when said latch point is in its position against said arrest shoulder means.

25. The device of claim 24 wherein said contact surface has a lateral length of between about 0.5 and 0.75 inches.

26. A breech device for assisting in drawing and releasing a bow string comprising body means having an upper portion, a lower portion, a forward portion and a rearward portion, trigger means pivotally mounted on said body means for pivoting between said forward and rearward portions and extending above said upper portion, latch arm means pivotally mounted on said body means and having a forward end section and a rearward end section, roller means eccentrically mounted by an axial offset on one of said trigger means or said latch arm means wherein said axial offset is from about 0.001 to about 0.100 in., a latch point on the other of said trigger means or latch arm means, the pivotal mounting for said latch arm means allowing downward pivoting of said latch arm means for engaging said latch point with said roller means to thereby cock said trigger means and prevent pivotal rearward movement of said trigger means in its firing direction until said trigger means is manually, forcibly, rearwardly pivoted from its cocked position toward its firing position, a bowstring keeper means extending downwardly on said forward end section of said latch arm means and adapted to lie in a position whereby tension applied to said keeper means by drawing of said bowstring will tend to pivot said latch arm means in a direction tending to forcibly maintain engagement of said latch point with said roller means and thereby maintain said cocked trigger position until the trigger is pulled to fire.

27. The device of claim 26 wherein a pivot radius line of said latch arm means and said trigger axis form a downwardly opening angle "α" of from about 75° to about 110° when said trigger means is in its cocked position, and wherein said keeper means is provided with a laterally extending, laterally convex bowstring contact surface which faces rearwardly and upwardly at an angle with respect to a longitudinal axis of said body member when said latch point is in its locked position against said roller means.

* * * * *